United States Patent [19]

Russell et al.

[11] Patent Number: 5,067,519

[45] Date of Patent: Nov. 26, 1991

[54] SAFETY VALVE FOR FLUID SYSTEMS

[75] Inventors: Neil E. Russell, Bloomfield Hills, Mich.; Owen H. Libby, Martin, Ga.

[73] Assignee: Ross Operating Valve Company, Troy, Mich.

[21] Appl. No.: 617,579

[22] Filed: Nov. 26, 1990

[51] Int. Cl.[5] ..... F15B 13/04

[52] U.S. Cl. ..... 137/596.14; 91/29; 91/446; 91/447; 91/451; 91/464; 137/107; 137/596.16; 137/596.18

[58] Field of Search ..... 91/29, 446, 447, 451, 91/464; 137/107, 596.14, 596.16, 596.18

[56] References Cited

U.S. PATENT DOCUMENTS

| | | | |
|---|---|---|---|
| Re. 30,403 | 9/1980 | Bitonti . | |
| 3,741,245 | 6/1973 | West | 137/596.18 |
| 4,561,464 | 12/1985 | Frantz | 137/596.18 |
| 4,794,951 | 1/1989 | Ryzner | 137/596.18 X |

*Primary Examiner*—Gerald A. Michalsky

*Attorney, Agent, or Firm*—Harness, Dickey & Pierce

[57] ABSTRACT

An improved safety valve includes piston-actuated provisions for gradually pressurizing a fluid-actuated motor during start-up of the system, preferably by way of a changeable flow restriction. In addition such improved safety valve preferably includes a floating exhaust valve actuating apparatus movable in an exhaust closure chamber and that operates in response to the presence or absence of line pressure in the exhaust closure chamber for respectively blocking off or opening fluid communication between the safety valve's outlet port and exhaust port. A pilot operator is also included for selectively permitting or cutting off line pressure flow to actuate the piston actuator and the exhaust valve actuating apparatus. The preferred safety valve also includes a check valve for preventing back-flow from the safety valve's outlet port back to the piston actuator and back to the exhaust valve actuating apparatus.

26 Claims, 2 Drawing Sheets

SAFETY VALVE FOR FLUID SYSTEMS

BACKGROUND AND SUMMARY OF THE INVENTION

The invention is related to that of U.S. Pat. No. RE.30,403, the disclosure of which is hereby incorporated by reference herein.

The invention relates generally to controls for industrial fluid control systems, and especially for pneumatic systems in which a reciprocable fluid motor is shifted between two positions by way of a four-way control valve or the like. Conventionally, such pneumatic systems have a three-way supply valve in the pressurized air supply line for feeding the control valve, with the supply valve being shiftable to its exhaust position in order to evacuate the system, and then later shifted back to its supply position for system operation. In some systems, this can result in sudden and potentially dangerous shifting of the controlled device Such a controlled device can be a press, for example, which can drift by gravity or by inadvertent external forces to one position when line air is depleted and then be suddenly shifted back to another position when full line pressure is applied.

It is known in the art to provide a piston-actuated, poppet safety valve between the supply and control valves, with such a safety valve being spring-urged to its closed position, but having a restricted bypass from the supply valve to both the piston chamber and outlet ports of the safety valve. With this arrangement, full air pressure will be initially prevented from flowing from the supply valve to the control valve when the former is opened, but instead will slowly build up in the safety valve actuating piston chamber and simultaneously on one side of the reciprocable fluid motor, thus slowly and safely shifting the motor to its opposite position. When the piston chamber pressure reaches a predetermined value, the safety valve will fully open and provide full supply pressure to the control valve for normal operation.

In some versions of such a safety valve, the flow restriction is in the form of a narrow hole drilled in the poppet valve member itself, with a restricted housing passage leading from the outlet port to the piston chamber. This prior construction has disadvantages, such as requiring the drilling of a separate hole in each poppet valve. Thus it has been found to be quite difficult to obtain satisfactory results in obtaining the right size of restriction, since extreme accuracy is required. Furthermore, in such a construction, it is impossible to vary or adjust the restriction size once the hole is drilled through the poppet valve member, with such adjustability often being very desirable.

These disadvantages were previously overcome and avoided by an improved safety valve described and disclosed in the previous U.S. Pat. No. RE.30,403, which is assigned to the same assignee as the present invention, with the disclosure of such patent being incorporated by reference herein. The invention of this patent provided a novel and improved safety valve construction for fluid systems of the type described, but which is more simple, economical, and convenient to construct. It further provided an improved safety valve that permitted convenient adjustability of its speed of operation.

The invention of such previous patent was adapted for use in combination with a compressed air supply line for a reciprocable fluid motor, with the supply line having a supply valve for selectively pressurizing and exhausting the supply line and a control valve for controlling the fluid motor. The safety valve was interposed between the supply and control valves, with the safety valve having a housing, supply and outlet ports in the housing, and a radial valve seat in the housing. A valve stem carrying a poppet valve member was engageable with the valve seat, and a spring urged the member against the valve seat, with an actuating piston being connected to the valve stem and movable within a piston chamber opening to one face of the housing. The piston chamber was enclosed by a cover on the housing face, with a first passage leading from the supply port to a portion of the piston chamber formed by the cover, with a second passage leading from this portion of the piston chamber to the outlet port, and with an adjustable restriction in the first passage. The relative dimensions of the piston and the spring were such that the piston would shift the valve member against the urging of the spring to its open position when a predetermined proportion of the full line pressure was reached.

In one embodiment of such previous invention, the adjustable restriction included a threaded portion in the first passage, adjacent the housing face, and a plurality of externally threaded plugs alternately and interchangeably mountable in the threaded portion, with the interchangeable plugs having restricted passages of various minimum diameters. In another version of such previous invention, the adjustable restriction was accomplished by way of a needle valve rotatably mounted in the cover and disposed within a portion of the first passage, whereby rotation of said needle valve in a flow orifice served to easily adjust the restriction size.

An improved safety valve according to the present invention includes piston-actuated provisions for gradually pressurizing the fluid motor during start-up of the system, preferably by way of a changeable flow restriction in a manner generally similar to that of the safety valve disclosed and described in the above-mentioned U.S. Pat. No. 30,403. In addition, however, such improved safety valve preferably includes a floating exhaust valve actuating apparatus movable in an exhaust closure chamber and that operates in response to the presence or absence of line pressure in the exhaust closure chamber for respectively blocking off or opening fluid communication between the safety valve's outlet port and exhaust port. A pilot operator is also included in the safety valve assembly in at least one embodiment of the invention for selectively permitting or cutting off line pressure flow to actuate the piston actuator and the exhaust valve actuating apparatus. Such pilot operator can alternately, however, be provided upstream of the safety valve inlet or supply port. The preferred safety valve also includes a check valve for preventing backflow from the safety valve's outlet port back to the piston actuator and back to the exhaust valve actuating apparatus.

These and other objects, advantages, and features of the present invention will become apparent from the following description and the appended claims, taken in conjunction with the accompanying drawings.

DETAILED DESCRIPTION OF THE PREFERRED EMBODIMENTS

Figure 1:
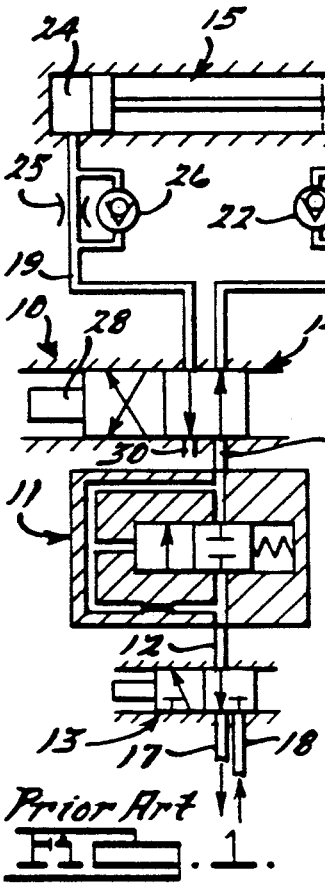
Prior Art FIG. 1.
FIG. 1 is a schematic view of a conventional pressurized air system for controlling a double-acting fluid motor and which incorporates a prior art safety valve.

FIGS. 1 through 4 illustrate various exemplary embodiments of a safety valve according to the present invention. Such safety valve is depicted in the drawings as incorporated into a pneumatic system for controlling the operation of a pneumatic fluid motor, which in turn actuates a driven device. One skilled in the art will readily recognize from the following description, taken in conjunction with the accompanying drawings and claims, that the principles of the present invention are not limited to the exemplary embodiments and pneumatic system shown for purposes of illustration in the drawings. The principles of the present invention are thus also applicable to other types of fluid systems and other applications.

FIG. 1 illustrates a typical pneumatic system 10 in which a prior art safety valve 11 of the type mentioned above may be used, with the prior art safety valve being shown schematically. The safety valve 11 is disposed in a pressurized air supply line 12 between a supply valve 13 (which can be air-actuated, electrically-actuated, or manually-actuated, for example) and a control valve 14. The control valve 14 is actuable to control the operation of a double-acting, reciprocable fluid motor 15, having a piston 20 or other movable member, and which can be a pneumatic cylinder, for example. The fluid motor 15 functions to operate a controlled member 16, such as a press or other driven member of a device. The supply valve 13 is typically a three-way valve movable between an exhaust position as shown in FIG. 1, in which the supply line 12 is connected to an exhaust port 17, and a supply position in which a source 18 of pressurized air is connected to the supply line 12. Typically, the supply valve 13 will be actuated or shifted to its open or supply position during operation of the pneumatic system 10, and shifted to its exhaust position when the pneumatic system 10 is shut down, with the supply valve 13 to be reshifted to its supply position upon resumption of system operations.

The control valve 14 is shown as a conventional four-way valve having a supply port 29 and an exhaust port 30 in order to pressurize or exhaust either of the two lines 19 and 21 leading respectively to the left-hand and right-hand chambers 24 and 23, respectively, of the fluid motor 15. In its position illustrated in FIG. 1, the control valve 14 supplies unrestricted pressure through a one-way check valve 22 to the right-hand chamber 23 of the fluid motor 15, shifting the control member 16 to the left. At the same time, air will leave the left-hand chamber 24 of the fluid motor 15 through a flow restriction 25 to exhaust. When the control valve 14 is shifted to its opposite position, pressurized air will flow unrestricted through a one-way check valve 26 to the left-hand chamber 24 of the fluid motor 15 and will exit the right-hand chamber 23 through a flow restriction 27 to exhaust. The control valve 14 will typically rest in one or the other of its positions, such as the position shown in FIG. 1, with the control valve 14 being shifted to its opposite position by actuation of a conventional operator 28, such as a solenoid or pilot valve, for example.

Without the presence of the safety valve 11, when the supply line 12 is shut down by moving the supply valve 13 to its exhaust position, all pressurized air would leave the system 10, including the fluid motor chambers 23 and 24. Even though the fluid motor 15 and the controlled member 16 might initially rest in their left-hand positions, as shown in FIG. 1, they could inadvertently drift or be shifted to their right-hand positions while the system 10 is shut down. Such drifting or shifting could occur as a result of gravity, or as a result of inadvertent external forces on the controlled member 16, for example. In such an instance, the control valve 14 would remain in the position shown in FIG. 1, which would otherwise have held the fluid motor 15 and the controlled member 16 in their left-hand positions by the force of air pressure. Thus, when the supply valve 13 is reopened, when the system 10 is started up, for example, the supply of immediate and full air pressure to the supply port 29 of the control valve 14 could result in a sudden and potentially dangerous leftward shifting of the fluid motor 15 and the controlled member 16. The flow restriction 25 would be of no avail in preventing such sudden shifting since there would be no residual air pressure in the previously exhausted left-hand chamber 24 when the fluid motor 15 starts its sudden leftward movement.

In order to prevent the undesirable situation described above, the safety valve 11 is interposed in the supply line 12, between the supply valve 13 and the control valve 14. Such prior art safety valve 11 can be any of a number of known safety valves, including the safety valve disclosed and described in the above-mentioned U.S. Pat. No. RE.30,403, which is owned by the same assignee as that of the present invention. Although such supply valve has performed well in the past, especially in terms of its provision of an easily replaceable or easily adjustable restriction for gradually shifting the fluid motor 15 and the controlled member 16 to their proper positions, the present invention provides for even further improvements in such a safety valve, especially in terms of economical reduction of components, maintenance, reduction of air leakage, and reduction of piping or plumbing.

Figure 2:
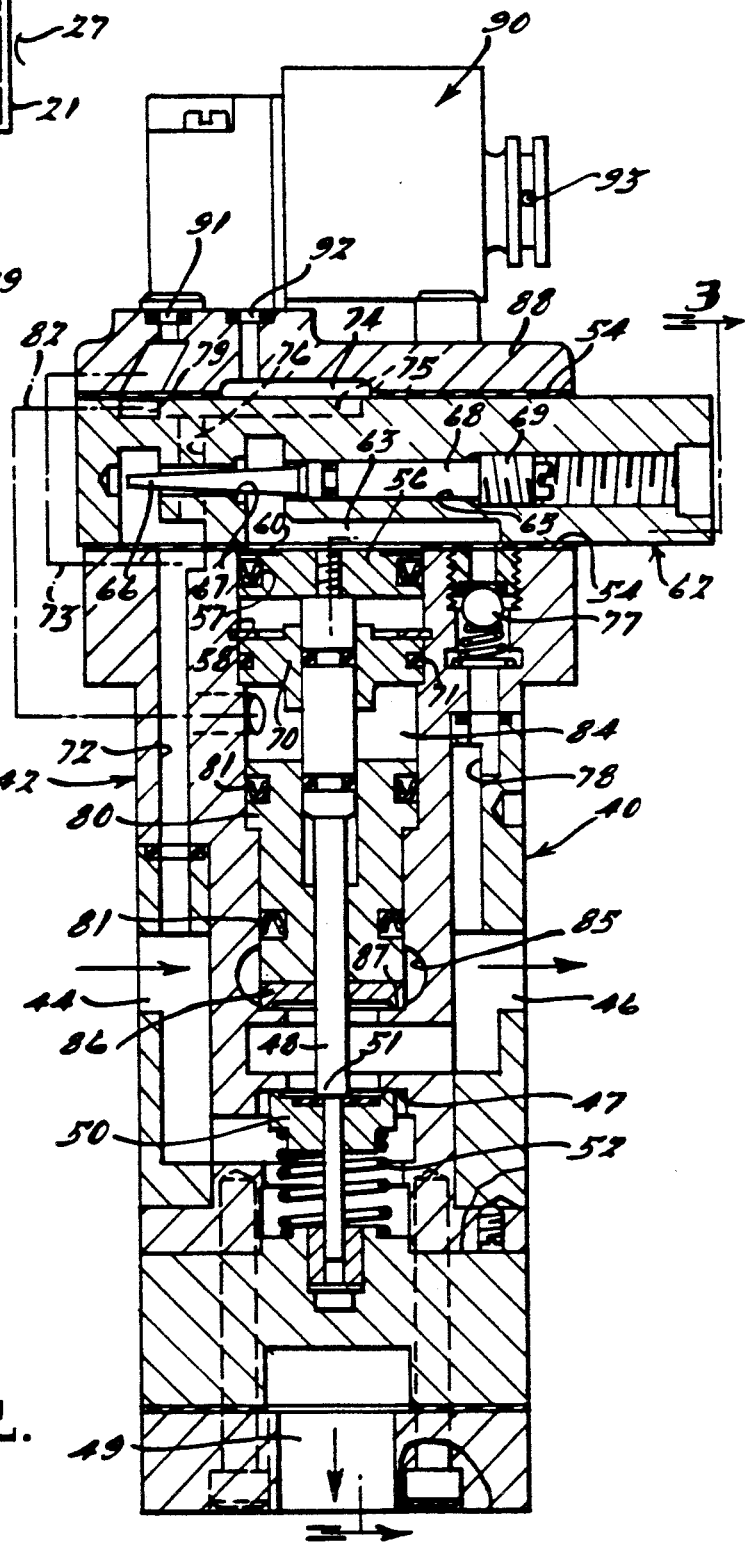
FIG. 2 is a cross-sectional view of an exemplary safety valve according to the present invention.
Figure 3:
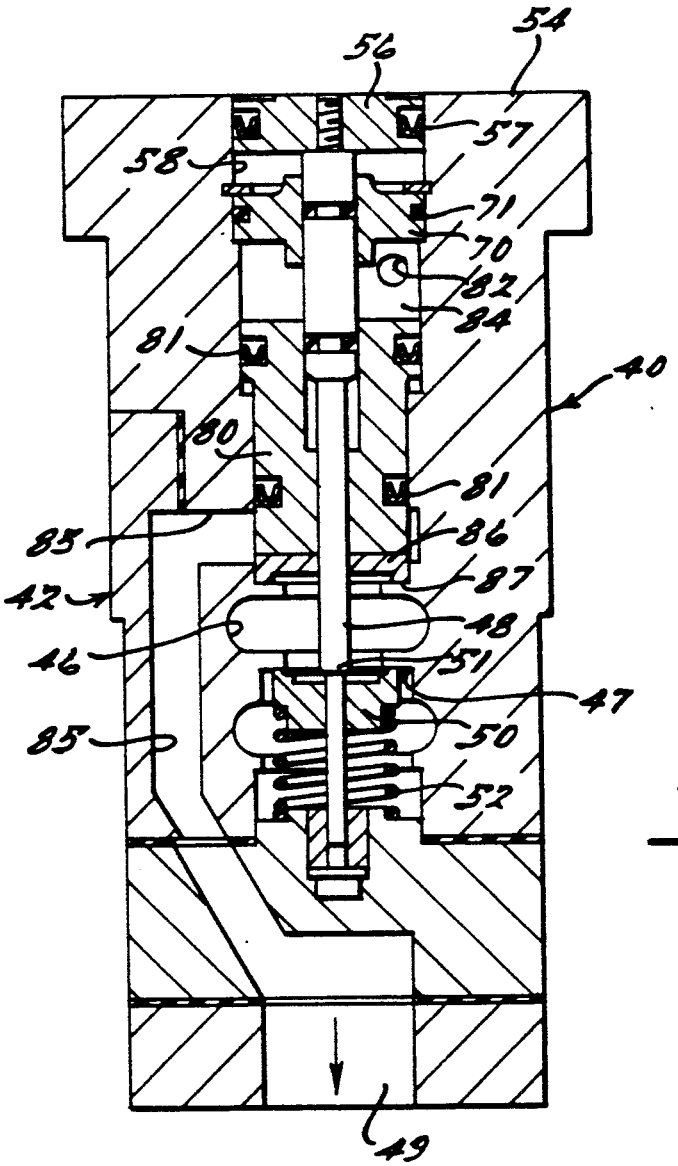
FIG. 3 is a partial cross-sectional view of a portion of the safety valve of FIG. 2, taken generally along line 3—3.
Figure 4:
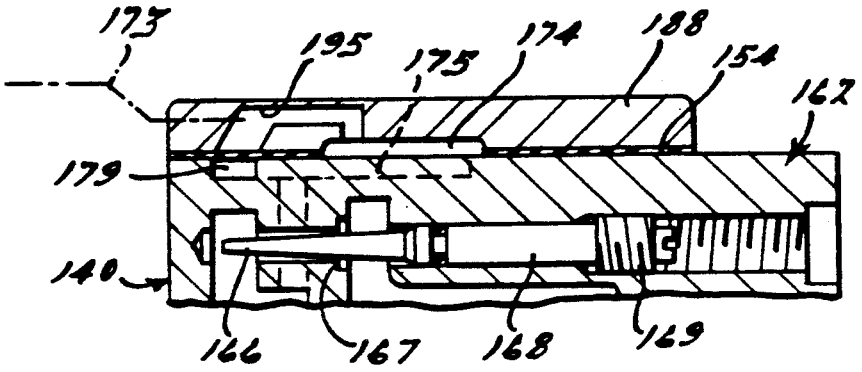
FIG. 4 is a partial cross-sectional view of a second embodiment of the invention in which the pilot or solenoid control for the safety valve is eliminated.

Such an improved safety valve according to the present invention is disclosed herein by way of two exemplary, illustrative embodiments, with an exemplary safety valve 40 being depicted in FIGS. 2 and 3, and with one exemplary variation on the present invention being depicted in the context of an alternate safety valve 140 in FIG. 4. In this regard, it should be pointed out that either of the exemplary safety valves 40 and 140 can be incorporated into the previously-discussed pneumatic system 10, with the safety valves 40 or 140 replacing the prior art safety valve 11 of FIG. 1. Most advantageously, however, the exemplary safety valves 40 or 140 of the present invention can also be employed to replace not only the safety valve 11 of FIG. 1, but also the supply valve 13.

Referring to FIGS. 2 and 3, the exemplary safety valve 40 according to the present invention includes a housing 42, a supply port 44, an outlet port 46, and an exhaust port 49. A valve seat 47 is formed within the housing 42, with a valve stem 48 extending through a bore 58 formed through the housing 42, with the valve stem 48 slidably carrying a poppet valve member 50. The poppet valve member 50 is biased into sealing engagement with the valve seat 47 by way of a spring 52 extending between the poppet valve member 50 and an internal portion of the housing 42 forming an end of the bore 58. As will be explained in more detail below, the primary force urging the poppet valve member 50 into sealing engagement with the valve seat 47 is provided by pressurized inlet air, rather than by the biasing force of the spring 52, at least in applications where the safety valve 40 is employed to replace both the safety valve 11 and the supply valve 13 in a pneumatic system such as that schematically illustrated in FIG. 1.

The opposite end of the valve stem 48 is rigidly interconnected with an upper piston 56, which is also disposed within the bore 58, and a stepped portion 51 of the valve stem 48 forcibly urges the poppet valve member 50 downwardly into an open position whenever the upper piston 56 is moved in a downward direction as viewed in FIG. 2. Also slidably carried on the valve stem 48 are a pressure block disc 70 sealingly disposed within the bore 58 by way of a seal 71, and an exhaust piston 80 sealingly engaging the interior of the bore 58 by way of a pair of seals 81, with the pressure block disc 70 and the exhaust piston 80 defining an exhaust closure chamber or cavity 84 in a portion of the bore 58.

A needle valve body 62 is secured to a generally flat face 54 of the housing 42, with the needle valve body having an enlarged opening 63, a portion of which is aligned with the bore 58 in order to form a piston chamber 60 for the upper piston 56. A needle valve member 66 is disposed within an opening extending through the needle valve body 62 for restricting flow through a flow orifice 67 formed within the needle valve body 62. The needle valve member 66 also includes a stem 68 having a threaded portion 69 on its opposite end for threadably engaging a threaded portion of a bore 65 extending through the needle valve body 62. Such threaded portion 69 of the stem 68 allows for adjustment of the position of the needle valve member 66 relative to the orifice 67, and therefore adjustment of the cross-sectional flow area of the flow orifice 67, thus allowing for an easily adjusted flow restriction such as that of the safety valve described and disclosed in the above-mentioned U.S. Pat. No. RE.30,403. The effect of this needle valve arrangement is described in more detail below in connection with the overall operation of the safety valve 40.

The safety valve 40 also includes an adaptor block 88 secured to a generally flat upper face of the needle valve body 62, and interconnects the needle valve body 62 with a pilot operator 90. The pilot operator is merely shown schematically in FIG. 2, and is preferably a three-way pilot valve that can be actuated by way of a pilot air signal or an electrical signal in the case of an electrical solenoid-operated pilot valve, or can even be a manually (and optionally lockable) valve, or it can be actuated by way of any of a number of other pilot actuation systems or devices well-known to those skilled in the art. The pilot operator generally includes an inlet port 91, and outlet port 92, and an exhaust port 93. In addition, as will be described in connection with the alternate embodiment illustrated in FIG. 4, the pilot operator can be optionally eliminated by providing fluid communication between the inlet port 91 and the outlet port 92, in which case the pressurized inlet air replaces the pilot air in applications where the control capabilities afforded by the pilot operator 90 are deemed to be unnecessary or undesirable. These and other optional variations on the safety valve 40 are explained in more detail below.

Various flow passages, ports, or chambers are provided in the safety valve 40 and provide fluid communication between various portions of the housing 42, the needle valve 62, the adaptor block 88, and the pilot operator 90. The interconnections and fluid flow paths of such ports, passages, and chambers are explained in detail in connection with the following discussion of the operation of the exemplary safety valve 40.

In order to describe the operation of the safety valve 40, it is first assumed that the safety valve 40 is incorporated within a pneumatic system, such as the pneumatic system 10 illustrated for purposes of illustration in FIG. 1, with the safety valve 40 replacing both the safety valve 11 and the supply valve 13 of FIG. 1. As is mentioned above, however, it should be noted that although one of the main advantages of the safety valve 40 is that it can be employed to replace both of such valves, namely safety valve 11 and supply valve 13, the safety valve 40 can also optionally be incorporated in a pneumatic system, such as the above-mentioned pneumatic system 10, in conjunction with the supply valve 13 being provided upstream between the air source 18 and the safety valve 40.

With reference to FIG. 1, in conjunction with FIGS. 2 and 3, it is assumed that the elements and components of the system 10 (with the safety valve 40 incorporated therein) are in an initial position as shown in FIG. 1, with the system in a down or "off" condition. Initially, the fluid motor 15 and the controlled member 16 may have been in the left-hand position shown in solid lines in FIG. 1. However, the fluid motor 15 and the controlled member 16 may have drifted or may have been inadvertently shifted to a right-hand position, such as that shown in phantom lines in FIG. 1. In this condition, the pilot operator 90 is in a de-energized condition with the system 10 at rest. Full inlet pressure exists in the supply port 44 and is communicated through a passage 72 extending through the housing 42 and a second passage 73 (which is shown schematically in phantom lines since it is not visible in the cross-sectional view of FIG. 2) to the pilot operator inlet port 91 extending through the adaptor block 88 to the pilot operator 90. Such inlet pressure is not communicated with the outlet port 92 of the pilot operator 90 since the pilot operator 90 is in its de-energized, or "off", condition. Similarly, pressurized inlet air is communicated through the supply port 44 to the lower side of the poppet valve member 50, with the poppet valve member 50 being urged into its closed position by the force of the inlet air pressure and by the biasing force of the spring 52. In such condition, the inlet air pressure in the inlet or supply port 44 is prevented from flowing through the housing 42 to the outlet port 46. It should be noted that in an optional installation wherein the safety valve 40 is used in conjunction with a supply valve 13, the above-described initial conditions will exist only after the supply valve 13 is shifted to its open position admitting pressurized air from the air source 18 to the inlet or supply port 44 of the safety valve 40.

When the system 10 is desired to be placed into operation, a signal (either pneumatic or electric, for example) is applied to actuate the pilot operator 90, thus opening fluid communication therethrough from the pilot inlet port 91 to the pilot outlet port 92. Thus, full air pressure is communicated through the adaptor block 88 to an opening 74, a chamber 75, and a passage 76 to the inlet side of the needle valve body 62. Such pressurized air flows in a selectively adjustable manner through the restriction between the needle valve member 66 and the flow orifice 67 to the opening 63 and the piston chamber 60, wherein such restricted flow of pressure acts on the upper surface of the upper piston 56. Such restricted flow pressure also flows through a one-way check valve 77, and through a passage 78 to the outlet port 46. Such flow, at a controlled rate from the outlet port 46 gradually shifts the fluid motor 15 and a controlled member 16 to their left-hand positions, assuming that they have previously drifted or been inadvertently shifted to their right-hand positions. Simultaneously, full inlet air pressure flows from the above-mentioned opening 74 and the chamber 75 in the needle valve body 62, through another passage 79 in the needle valve body 62 and a schematically-represented passage 82 into the exhaust closure cavity 84 in the housing 42, above the exhaust piston 80. Because the exhaust piston 80 is held in its closed position by the force of the air pressure in the exhaust closure chamber or cavity 80, with the exhaust valve member 86 seated on the exhaust seat 87, air flow is prevented between the outlet port 46, through the exhaust passage 85, to the exhaust port 49.

As the fluid motor 15 and the controlled member 16 are gradually shifted to their left-hand positions, pressure within the opening 63 and the piston chamber 60 builds until it reaches a predetermined value, such as 30 to 40 psi in a 120 psi system, for example, and the force of the inlet pressure on the lower side of the poppet valve member 50, along with the biasing force of the spring 52, will be overcome due to the larger area of the upper piston 56 relative to the area of the poppet valve member 50, thus forcing the poppet valve member 50 to be quickly shifted to its open position, by way of the engagement of the stepped portion 51 of the stem 48, thus opening full inlet pressure to the system 10 by way of the outlet port 46. During this operation, because the area of the top of the exhaust piston 80 is greater than the area of the bottom of the exhaust piston 80 the exhaust piston 80 remains in its previously described closed position. At this point in the sequence of operation, the safety valve 40 remains open and operation of the fluid motor 15 is accomplished in a conventional manner, by way of actuation of the control valve 14 described above in connection with the exemplary pneumatic system 10.

When the pilot operator 90 is again de-energized and placed in its closed or "off" position, air pressure is depleted from the piston chamber 60, by way of the pilot operator 90 venting to exhaust through its exhaust port 93, and the force of the inlet air pressure and/or the biasing force of the spring 52 causes the poppet valve member 50 to be closed, with the check valve 77 preventing flow from the outlet port 46 back to the piston chamber 60 and back to the exhaust closure chamber or cavity 84. Simultaneously, inlet pressure from the inlet port 44 is blocked from flowing through the safety valve 40 to the outlet port 46. Also because of the pilot operator 90 venting to exhaust through its exhaust port 93, pressure is depleted from the chamber 75 and the passages 79 and 82, thus exhausting the exhaust closure cavity 84. As a result, the exhaust piston 80 and its associated exhaust valve member 86 are urged upwardly, as viewed in FIGS. 2 and 3, under the influence of air pressure from the outlet port 46, thus opening the outlet port 46 to fluid communication with the exhaust passage 85, through which the system is exhausted through the exhaust port 49. Once in its down or "off" condition, the pneumatic system 10 is shut down and does not function to actuate the fluid motor 15 and the controlled member 16, thus returning the pneumatic system 10 to the initial condition described above, wherein drifting or inadvertent shifting of the fluid motor 15 and the controlled member 16 can occur. Thus, it can now be seen that the exemplary safety valve 40 can be employed in a pneumatic system such as the pneumatic system 10, for example, in order to actuate and de-actuate the system, with a safe, gradual build-up of pressure in the system that prevents sudden and potentially dangerous return of previously drifted or shifted components thereof to an appropriate starting position.

As mentioned above, the exemplary safety valve 40, with its pneumatic, electric, or manual pilot operator 90, can be used in a pneumatic system such as the pneumatic system 10, either with or without being combined with a supply valve 13. One of the primary advantages of the safety valve 14, with its pilot operator 90, is that in most instances the control and function afforded by the pilot operator 90 renders the supply valve 13 unnecessary. In this regard, it should also be pointed out that the pilot operator 30 can optionally be a manually operated three-way pilot valve, which can also optionally include a lock-out feature, such as the lock-out valve marketed under the trademark L-O-X by Ross Operating Valve Company, the assignee of the present invention. In such an application, the opening, closing, and exhaust functions of the pilot operator 90 can be manually achieved by operation of the manually operated three-way pilot valve and can be locked in an open or in a closed position, in order to substantially prevent unauthorized tampering with the system, either in its operating or in its de-energized conditions. It should also be noted that the needle valve arrangement described above can optionally be replaced by the interchangeable, different-sized restriction orifice plugs described in the above-mentioned U.S. Pat. No. RE.30,403, although the needle valve arrangement is felt to be more advantageous in terms of its wider and more continuous range of orifice restriction size adjustability.

FIG. 4 illustrates an optional alternative to the high degree of control achieved with the exemplary safety valve 40, in which an alternate safety valve 140 is substantially similar in configuration and function to the safety valve 40, with the exceptions noted below. Thus, components and elements of the safety valve 140 of FIG. 4 are indicated by reference numerals similar to those of corresponding or similar components or elements of the safety valve 40, but having one-hundred prefixes.

In FIG. 4, the adaptor block 88 and the pilot operator 90 of the safety valve 40 of FIGS. 2 and 3, have been replaced by an optional, straight-through adaptor block 188. The adaptor block 188 includes a straight-through passage 195 that provides straight-through fluid communication between the passage 173 (corresponding to the passage 73 in FIG. 2) to the opening 174 and the chamber 175 in the needle valve body 162. As mentioned above, such optional adaptor block 188, with its straight-through fluid communication, eliminates the control afforded by the pilot operator 90 in the previously described safety valve 40 of FIGS. 2 and 3, but the safety valve 140 still retains the gradual start-up feature for the pneumatic system, thus preventing the sudden and potentially dangerous shifting of the fluid motor 15 and the controlled member 16, as described above. Such optional adaptor block 188 in the associated safety valve 140 illustrated in FIG. 4 can be advantageously and economically employed in systems wherein the supply valve 13 is retained for starting up or shutting down the pneumatic system 10, for example. One skilled in the art will also readily recognize other applications wherein a straight-through device, such as the adaptor block 188 in FIG. 4, for example, can advantageously be employed. One such example is when a safety valve according to the present invention is retrofitted in a pneumatic system already including a supply valve 13, and wherein a low-cost installation is desired or where the high degree of control afforded by the pilot operator 90 is deemed unnecessary.

The foregoing discussion discloses and describes merely exemplary embodiments of the present invention for purposes of illustration only. One skilled in the art will readily recognize from such discussion, and from the accompanying drawings and claims that various changes, modifications and variations can be made therein without departing from the spirit and scope of the invention as defined in the following claims.

What is claimed is:

1. In a fluid system having a fluid-operated device and a supply line for supplying pressurized fluid to said device at a predetermined line pressure, a safety valve interposed in said supply line, said safety valve comprising: a housing with supply, outlet, and exhaust ports in said housing; a movable poppet valve member carried by a valve stem for providing fluid communication between said supply and outlet ports when in an open position and for preventing said fluid communication when in a closed position, said line pressure tending to forcibly urge said poppet valve member to its closed position; a piston movable in a piston chamber in said housing and connected to said valve stem; first passage means in said housing leading from said supply port to said piston chamber; second passage means in said housing leading from said piston chamber to said outlet port; and restriction means for restricting fluid flow in said first passage means; the relative dimensions of said piston and said poppet valve member being such that said piston and said valve stem will shift said poppet valve member to its open position against the force of said line pressure when a predetermined proportion of said line pressure has been reached in said piston chamber; said safety valve also including an exhaust piston movable in an exhaust closure chamber within said housing; an exhaust valve member connected to said exhaust piston and movable therewith between an open position providing fluid communication between said outlet and exhaust ports and a closed position preventing fluid communication therebetween; third passage means in said housing leading from said supply port to said exhaust closure chamber so that said line pressure can forcibly act on said exhaust piston and tend to urge said exhaust valve member to its closed position, operator means selectively actuable between at least two positions respectively permitting and cutting off flow of said line pressure to said piston chamber and to said exhaust closure chamber; and the relative dimensions of said exhaust piston and said exhaust valve member being such that said exhaust valve member will shift to its closed position when said line pressure is present in said exhaust closure chamber and such that said exhaust valve member will shift to its open position in order to exhaust said outlet port through said exhaust port when said line pressure is cut off from said exhaust closure chamber.

2. A safety valve according to claim 1, wherein said exhaust piston and said exhaust valve member are slidably disposed on said valve stem.

3. A safety valve according to claim 1, wherein said safety valve includes a one-way check valve in said second passage means for permitting flow therethrough only from said piston chamber to said outlet port.

4. A safety valve according to claim 1, wherein said operator means is a fluid-actuated pilot valve interposed in said first passage means between said supply port and said restriction means and between said supply port and said third passage means.

5. A safety valve according to claim 1, wherein said operator means is an electrically-actuated pilot valve interposed in said first passage means between said supply port and said restriction means and between said supply port and said third passage means.

6. A safety valve according to claim 1, wherein said operator means is a mnually-actuated pilot valve interposed in said first passage means between said supply port and said restriction means and between said supply port and said third passage means.

7. A safety valve according to claim 6, wherein said manually-actuated valve includes locking means for selectively locking said manually-actuated valve in at least said position cutting off flow of said line pressure to said piston chamber and said exhaust closure chamber.

8. A safety valve according to claim 1, wherein said operator means is a fluid-actuated valve interposed in said supply line upstream from said supply port of said safety valve.

9. A safety valve according to claim 1, wherein said operator means is an electrically-actuated valve interposed in said supply line upstream from said supply port of said safety valve.

10. A safety valve according to claim 1, wherein said operator means is a manually-actuated valve interposed in said supply line upstream from said supply port of said safety valve.

11. A safety valve according to claim 1, wherein said restriction means includes a flow orifice in said first passage means, said flow orifice having a cross-sectional flow area smaller than at least a portion of said first passage means upstream of said orifice.

12. A safety valve according to claim 11, wherein said safety valve includes adjustment means for selectively changing said cross-sectional flow area through said flow orifice.

13. A safety valve according to claim 12, wherein said adjustment means includes a needle valve member partially protruding into said flow orifice and means for selectively moving said needle valve member farther into and out of said flow orifice in order to adjustably change the cross-sectional flow area therethrough.

14. A safety valve according to claim 1, wherein said fluid system is an air system, said line pressure being pressurized air pressure.

15. In a fluid system having a fluid-operated device and a supply line for supplying pressurized fluid to said device at a predetermined line pressure, a safety valve interposed in said supply line, said safety valve comprising: a housing with supply, outlet, and exhaust ports in said housing., a movable poppet valve member carried by a valve stem for providing fluid communication between said supply and outlet ports when in an open position and for preventing said fluid communication when in a closed position, said line pressure tending to forcibly urge said poppet valve member to its closed position; a piston movable in a piston chamber in said housing and connected to said valve stem; first passage means in said housing leading from said supply port to said piston chamber; second passage means in said housing leading from said piston chamber to said outlet port; and restriction means for restricting fluid flow in said first passage means; the relative dimensions of said piston and said poppet valve member being such that said piston and said valve stem will shift said poppet valve member to its open position against the force of said line pressure when a predetermined proportion of said line pressure has been reached in said piston chamber; said safety valve also including an exhaust piston movable in an exhaust closure chamber within said housing; an exhaust valve member connected to said exhaust piston and movable therewith between an open position providing fluid communication between said outlet and exhaust ports and a closed position preventing fluid communication therebetween; third passage means in said housing leading from said supply port to said exhaust closure chamber so that said line pressure can forcibly act on said exhaust piston and tend to urge said exhaust valve member to its closed position; operator means selectively actuable between at least two positions respectively permitting and cutting off flow of said line pressure to said piston chamber and to said exhaust closure chamber; the relative dimensions of said exhaust piston and said exhaust valve member being such that said exhaust valve member will shift to its closed position when said line pressure is present in said exhaust closure chamber and such that said exhaust valve member will shift to its open position in order to exhaust said outlet port through said exhaust port when said line pressure is cut off from said exhaust closure chamber; said safety valve further including a one-way check valve in said second passage means for permitting flow therethrough only from said piston chamber to said outlet port; and said restriction means including a flow orifice in said first passage means, said flow orifice having a cross-sectional flow area smaller than at least a portion of said first passage means upstream of said orifice.

16. A safety valve according to claim 15, wherein said exhaust piston and said exhaust valve member are slidably disposed on said valve stem.

17. A safety valve according to claim 15, wherein said operator means is a fluid-actuated pilot valve interposed in said first passage means between said supply port and said restriction means and between said supply port and said third passage means.

18. A safety valve according to claim 15, wherein said operator means is an electrically-actuated pilot valve interposed in said first passage means between said supply port and said restriction means and between said supply port and said third passage means.

19. A safety valve according to claim 15, wherein said operator means is a manually-actuated pilot valve interposed in said first passage means between said supply port and said restriction means and between said supply port and said third passage means.

20. A safety valve according to claim 19, wherein said manually-actuated valve includes locking means for selectively locking said manually-actuated valve in at least said position cutting off flow of said line pressure to said piston chamber and said exhaust closure chamber.

21. A safety valve according to claim 15, wherein said operator means is a fluid-actuated valve interposed in said supply line upstream from said supply port of said safety valve.

22. A safety valve according to claim 15, wherein said operator means is an electrically-actuated valve interposed in said supply line upstream from said supply port of said safety valve.

23. A safety valve according to claim 15, wherein said operator means is a manually-actuated valve interposed in said supply line upstream from said supply port of said safety valve.

24. A safety valve according to claim 15, wherein said safety valve includes adjustment means for selectively changing said cross-sectional flow area through said flow orifice.

25. A safety valve according to claim 24, wherein said adjustment means includes a needle valve member partially protruding into said flow orifice and means for selectively moving said needle valve member farther into and out of said flow orifice in order to adjustably change the cross-sectional flow area therethrough.

26. A safety valve according to claim 15, wherein said fluid system is an air system, said line pressure being pressurized air pressure.

* * * * *

UNITED STATES PATENT AND TRADEMARK OFFICE

CERTIFICATE OF CORRECTION

PATENT NO. : 5,067,519

DATED : November 26, 1991

INVENTOR(S) : Russell, et al

It is certified that error appears in the above-identified patent and that said Letters Patent is hereby corrected as shown below:

Column 1, line 20, after "device" insert --.--.

Column 9, line 62, Claim 1, "," should be --;--.

Column 10, line 25, Claim 6, "mnually-actuated" should be --manually-actuated--.

Column 11, line 2, Claim 15, "." should be --;--.

Signed and Sealed this

Sixteenth Day of March, 1993

*Attest:*

STEPHEN G. KUNIN

*Attesting Officer*

*Acting Commissioner of Patents and Trademarks*